US005207203A

United States Patent [19]

Wagner et al.

[11] Patent Number: 5,207,203

[45] Date of Patent: May 4, 1993

[54] FUEL SYSTEM

[75] Inventors: Richard W. Wagner, Albion; Michael R. Raney, Rochester, both of N.Y.

[73] Assignee: General Motors Corporation, Detroit, Mich.

[21] Appl. No.: 855,968

[22] Filed: Mar. 23, 1992

[51] Int. Cl.[5] ..... F02M 37/04

[52] U.S. Cl. ..... 123/514; 123/557; 123/456

[58] Field of Search ..... 123/514, 510, 516, 557, 123/511, 512, 456, 497

[56] References Cited

U.S. PATENT DOCUMENTS

| | | | |
|---|---|---|---|
| 3,762,379 | 10/1973 | Hobo | 123/497 |
| 3,913,547 | 10/1975 | Wentworth | 123/497 |
| 4,187,813 | 2/1980 | Stumpp | 123/557 |
| 4,274,380 | 10/1981 | de Vulpillieres | 123/514 |
| 4,377,149 | 3/1983 | Naylor | 123/557 |
| 4,432,239 | 2/1984 | Redele | 123/557 |
| 4,440,138 | 4/1984 | Smith | 123/514 |
| 4,452,213 | 6/1984 | Doprez | 123/514 |
| 4,553,697 | 11/1985 | Nothen | 123/557 |
| 4,600,825 | 7/1986 | Blazejovsky | 123/557 |
| 5,002,030 | 3/1991 | Mahnke | 123/469 |
| 5,085,198 | 2/1992 | Bartlett | 123/557 |

FOREIGN PATENT DOCUMENTS

| | | | |
|---|---|---|---|
| 0091363 | 5/1983 | Japan | 123/514 |

*Primary Examiner*—Carl S. Miller
*Attorney, Agent, or Firm*—Karl F. Barr

[57] ABSTRACT

A fuel system for an internal combustion engine is disclosed having a fuel distributor to which one or more injectors are operably connected for injecting fuel into the intake manifold of the engine. A valve assembly in the system has a valve which is disposed for movement between a first position in which fuel is recirculated through the distributor for return to the fuel supply, and a second position in which fuel supplied to the distributor is not recirculated to the supply thereby eliminating returned fuel as a heat source for said fuel supply when the valve is in the second position.

2 Claims, 3 Drawing Sheets

FUEL SYSTEM

BACKGROUND OF THE INVENTION

1. Field of the Invention

The present invention is directed to a fuel system for an internal combustion engine and, more particularly, to a fuel system having means for switching from a recalculating system in which unused fuel is returned to the fuel tank to a non-recalculating, dead-headed system which avoids fuel return and consequential fuel tank warming.

2. Description of the Relevant Art

Fuel injected internal combustion engines are employed as an alternative to conventional carburated engines. Such systems provide a more accurate means, as compared with carburated engines, to control a variety of engine operating parameters via an on-board electronic control module (ECM).

Fuel is typically supplied to a fuel injected engine via a fuel distributor which is operably connected to a series of fuel injectors. The injectors are mated to an engine intake in such a manner that they are positioned within respective intake ports of the engine. Pressurized fuel from one or more fuel pumps, which draw fuel from a supply, is circulated to the fuel distributors where it is dispensed by the injectors. In many cases, excess supplied fuel is recirculated to the fuel tank by a pressure relief valve which maintains correct fuel pressure within the fuel distributor. Recirculation of fuel is, in most cases, only required during operating periods when fuel vapor is a possibility in the fuel distributor. Otherwise, the effect of recirculation is to return fuel, which has been heated by passage through the engine bay, to the fuel tank causing an increase in tank fuel temperature and vehicle emission running losses.

SUMMARY OF THE INVENTION

The present invention discloses a fuel system, for a fuel injected internal combustion engine, having a valve assembly operable to recirculate fuel through a fuel distributor assembly and to the fuel tank during predetermined periods of engine operation and to prevent recirculation of fuel therethrough during other predetermined periods of engine operation.

The fuel system comprises a fuel tank and fuel pump for supply of pressurized fuel to the engine. A fuel distributor is mounted to an internal combustion engine and has inlet and outlet fittings for the passage of fuel therethrough. Disposed at a location between the pressurized fuel supply and the inlet and outlet fittings of the distributor is a recirculation valve assembly comprising a solenoid operated valve, a pressure regulator, and supply conduit means for conducting high pressure fuel from the fuel pump through the valve assembly and to the fuel rail. In addition, return conduit means are established for regulating the flow of fuel returning from the fuel rail. The pressure regulator operates within the return conduit to maintain a desired pressure at the fuel distributor and to return fuel through a return fuel line to the fuel tank.

Signals from a controller, such as the engine control module (ECM), are generated based on various engine parameters which indicate the need for fuel recirculation. During such periods that recirculation is indicated, the solenoid operated valve is positioned to allow high pressure fuel from the fuel pump to pass through the supply conduit means through the fuel distributor, and back to the fuel tank through the return conduit means. When conditions signal that recirculation of fuel is no longer desirable, the valve is positioned by the solenoid to close the supply conduit means and to pass high pressure fuel through the return conduit means to the fuel distributor. Since the valve has closed the supply conduit means, fuel entering the fuel distributor through the return conduit will be dead-headed therein, so as to prevent recirculation of excess, heated fuel to the fuel tank and consequent heating of the fuel supply. Since the fuel is supplied to the fuel distributor through the return conduit means when the valve has been shifted to the dead-head position, the pressure regulator, operable in the return conduit, maintains pressure at the fuel distributor by fuel spill, or recirculation upstream thereof, before the fuel has been heated Other objects and features of the present invention will become apparent by reference to the following description and to the drawings.

DESCRIPTION OF THE PREFERRED EMBODIMENT

Figure 3:
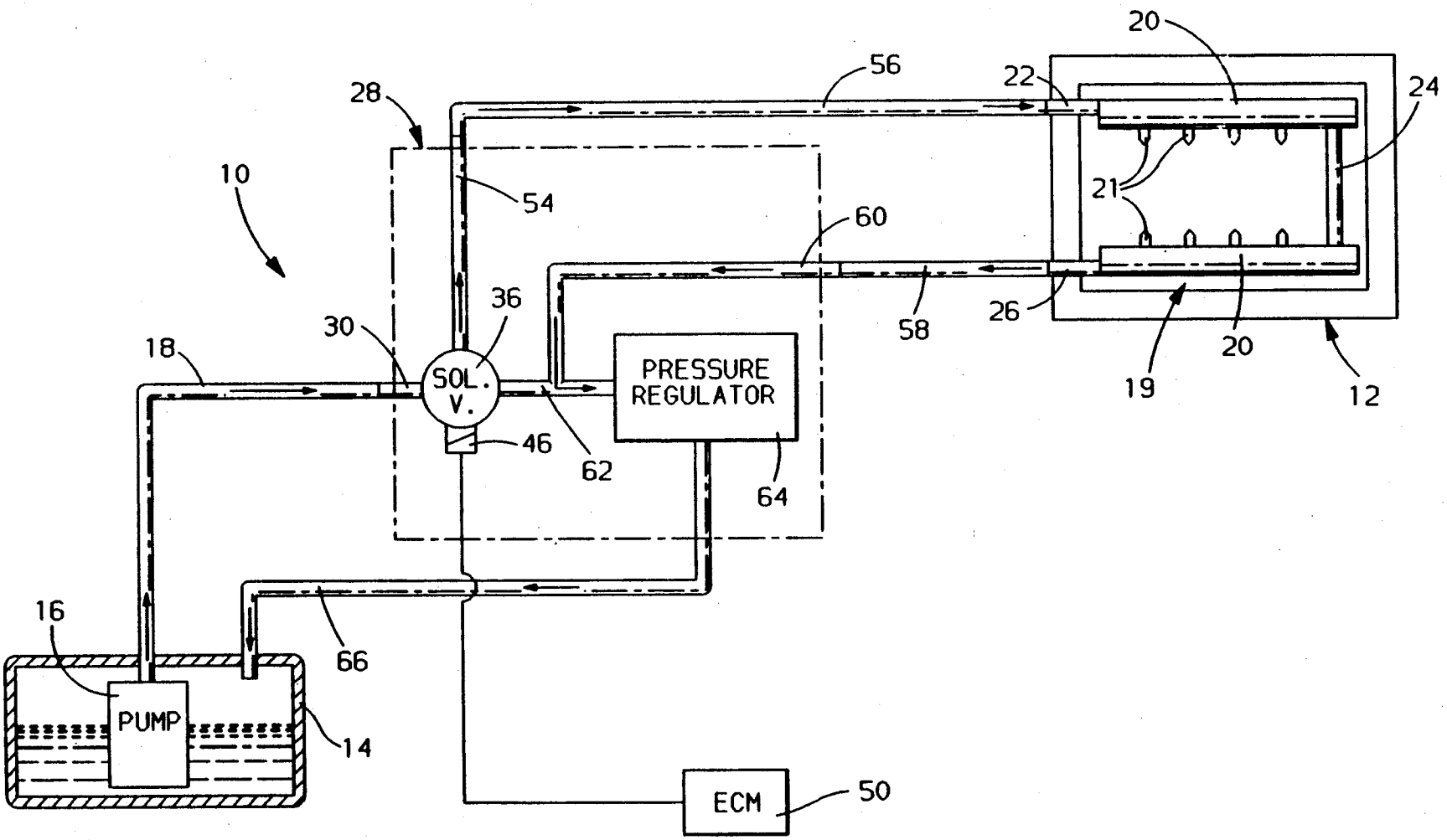
FIG. 3 is a schematic view of the fuel system of the present invention in a recirculation mode.

In FIG. 3, there is shown a fuel system, designated generally as 10, for use in a fuel injected internal combustion engine 12. The fuel system 10 has a fuel supply such as tank 14 and fuel pump 16. The pump 16 maintains fuel at a desired pressure in fuel supply line 18. The location of pump 16 within the fuel tank 14 is but one possible location. It is contemplated to place the pump in a location outside of the tank and, in addition, more than one fuel pump may be used depending on the particular application.

Figure 4:
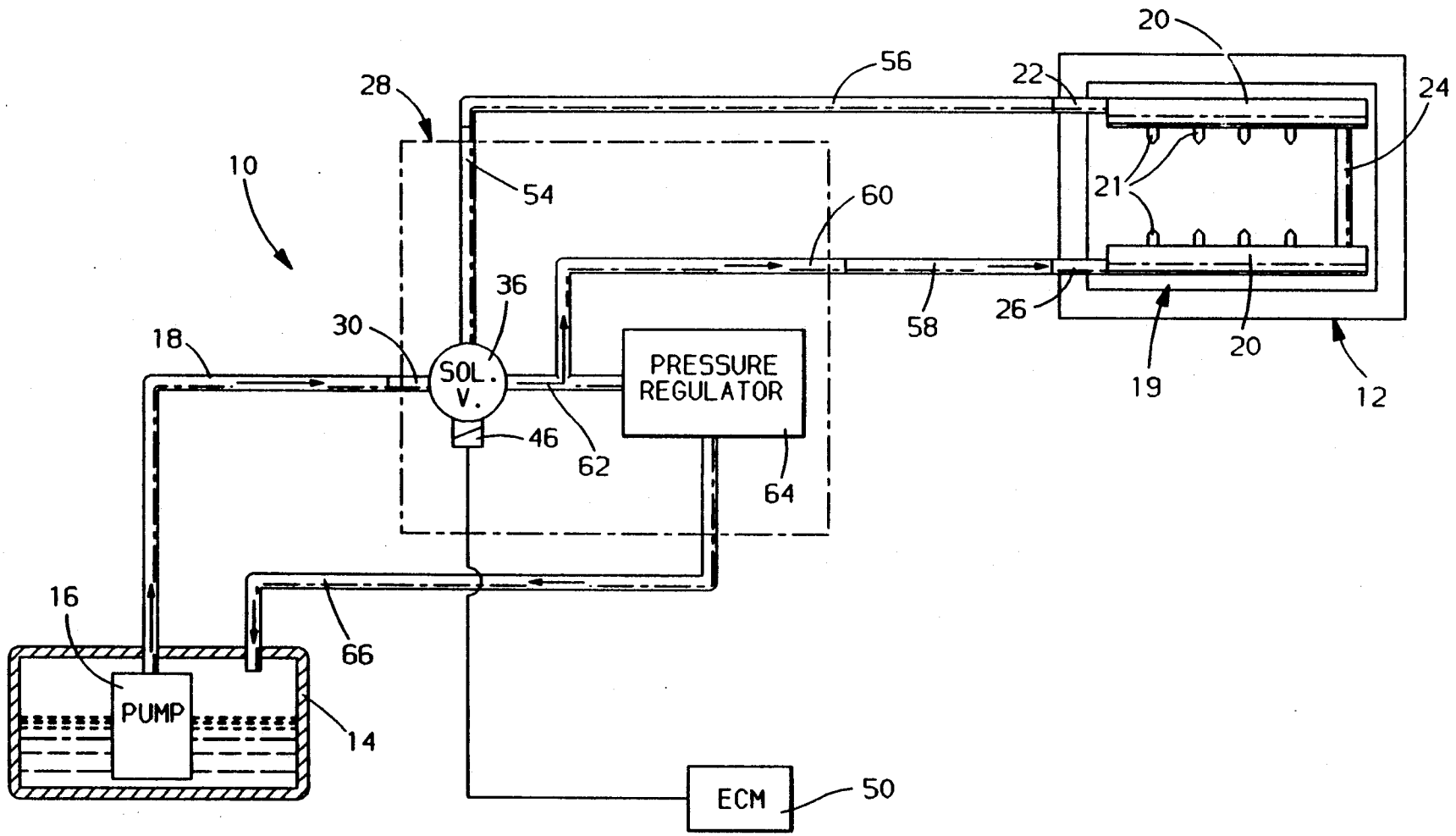
FIG. 4 is a schematic view of the fuel system of FIG. 3 shown in the non-recirculation mode.

High pressure fuel from pump 16 is supplied to the engine 12 by a fuel distributor 19. In a preferred embodiment, the distributor 19 comprises one or more fuel conduits or rails 20 to which a series of fuel injectors 21 are operably connected. The number of injectors corresponds to the number of engine cylinders while the number of fuel rails 20 is generally dictated by the engine configuration. As shown in FIGS. 3 and 4, two fuel rails are employed for a v-configured engine. The injector-rail assembly is mated to an engine intake in such a manner that the injectors 21 are positioned within respective intake ports of the engine. Pressurized fuel supplied by pump 16 from fuel tank 14 enters a fuel rail 20 of distributor 19 through an inlet 22 where it is dispensed by the injectors 21. In fuel distributors having multiple fuel rails such as that disclosed in the figures, a connecting conduit 24 transfers fuel between two fuel rails 20. Excess fuel is allowed to exit the fuel distributor 19 through outlet 26.

Figure 1:
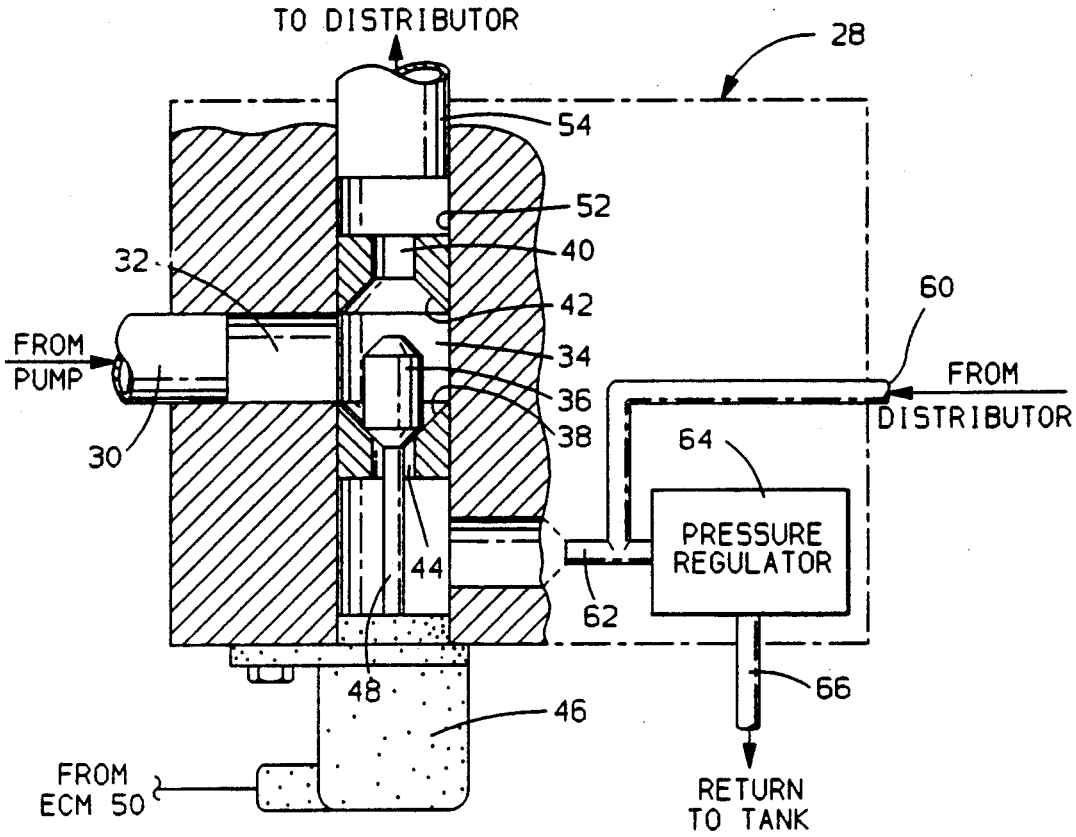
FIG. 1 is a schematic view of a valve assembly of the present invention in a fuel recirculation position.

Disposed between fuel supply tank 14 and fuel rail 20 is a recirculation valve assembly 28 through which the high pressure fuel supplied to the fuel distributor 19 passes. The valve assembly, shown in detail in FIGS. 1 and 2, has a fuel inlet 30 which receives pressurized fuel from supply line 18 and a supply conduit 32 which conducts the fuel to a valve chamber 34 within which a valve 36 is disposed for reciprocable operation between a first position, shown in FIG. 1, in which the valve 36 engages seat 38 allowing fuel to pass through opening 40 and a second position, shown in FIG. 2, in which the valve 36 is engaged with seat 42, which extends about opening 40, allowing fuel to pass through opening 44 in valve seat 38. The valve is actuated by a solenoid 46 which is operably connected to valve 36 through valve stem 48. Control of the solenoid 46 is through electrical signals generated by a controller such as Engine Control Module (ECM) 50 which issues instructions to the solenoid based on information received from a variety of engine operation sensors to be discussed in further detail below.

Returning to FIGS. 1 and 3, when the solenoid 46 has positioned valve 36 in the first position allowing fuel to pass through opening 40 in valve seat 42, fuel passes through conduit 52 in valve assembly 28 to outlet 54 where it passes through fuel distributor supply conduit 56 which is operably connected to inlet 22, thereby supplying fuel under pressure to the rail 20 for supply to the engine 12 by the fuel injectors 21. As is typical, an excess of fuel is supplied to the distributor 19 and exits via outlet 26 which is connected to a fuel distributor return conduit 58. Conduit 58 extends between the outlet 26 and a fuel return inlet 60 in valve assembly 28. The inlet 60 admits fuel to fuel conduit 62 in valve assembly 28, said conduit connecting the inlet 60 with fuel pressure regulator 64 which acts to maintain fuel pressure within the fuel rail 20 by regulating return of excess fuel from the fuel rail 20 to a predetermined pressure. Once a desired pressure within the fuel rail 20 is reached, return fuel from return conduit 58 is spilled through the pressure regulator 64 to fuel return line 66 through which the fuel is returned to the fuel tank 14.

The configuration of the fuel system 10, and more specifically, the fuel valve assembly 28 in the mode described above, is to recirculate a quantity of fuel through the fuel distributor 19 and back to fuel tank 14. Fuel recirculation may be important under certain engine operating conditions, such as hot start-up and hot idle conditions, to remove fuel vapor from the fuel rail 20 which could act to inhibit the proper flow of fuel to the injectors without recirculation. Recirculation is not always required for adequate engine operation and, from the standpoint of running emission loss, may be undesirable. Fuel which passes through the engine compartment and fuel distributor, particularly in fuel systems employing fuel rail-injector assemblies, absorbs heat from the various components through which it passes. This heat is in turn carried to the fuel tank by way of the return fuel where it heats the entire fuel supply. Warming of the fuel supply may lead to an increase in fuel tank vapor and, consequently, an increase in fuel vapor release to the atmosphere.

Figure 2:
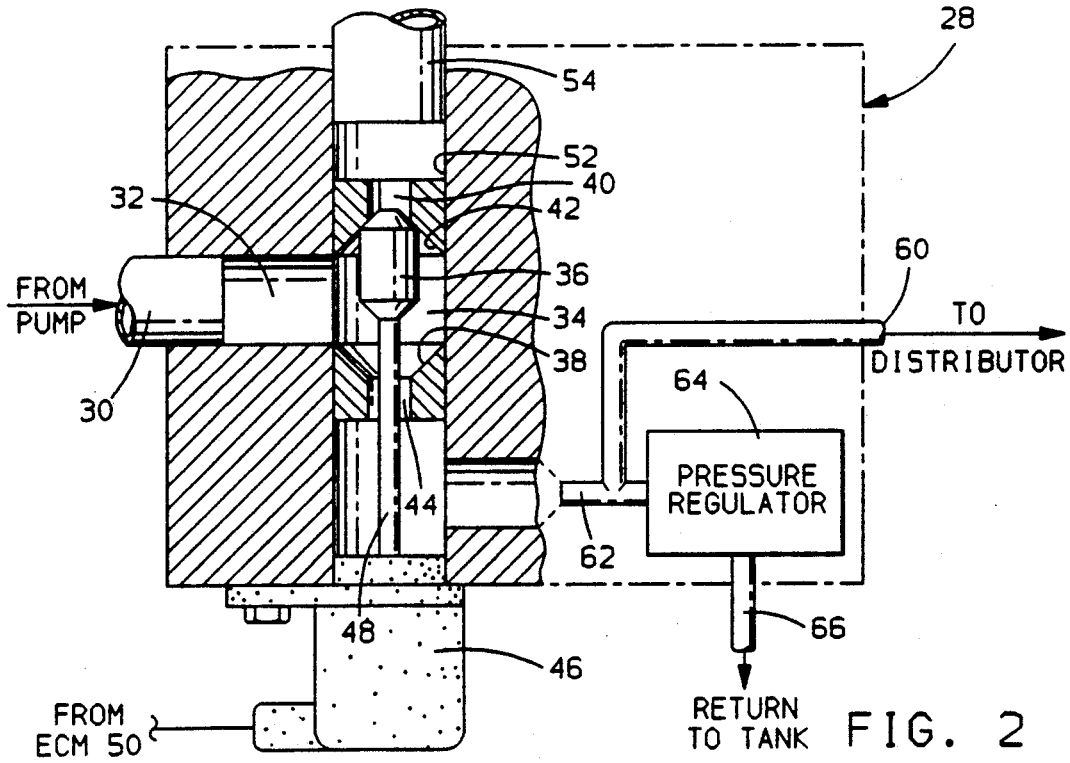
FIG. 2 is a schematic view of the valve assembly of FIG. 1 shown in the non-recirculation position.

During periods of engine operation which do not require fuel recirculation, the fuel system 10 is configured as illustrated in FIGS. 2 and 4. In response to a signal from ECM controller 50, the solenoid 46 moves valve 36 into engagement with valve seat 42 thereby blocking fuel flow through opening 40 and directing flow through opening 44 in valve seat 38. Supply conduit 30 is now in communication with conduit 62 allowing high pressure fuel from supply line 18 to be supplied to fuel distributor 19 through fuel distributor return conduit 58. Excess fuel passing through fuel rail 20 and exiting by way of fuel conduit 56 is dead-headed at valve assembly 28 by the action of the valve against seat 42. Pressure is maintained within the fuel rail by pressure regulator 64 which spills supply fuel out of conduit 62 and back to the fuel tank 14 through return line 66. In this configuration, the return fuel is spilled prior to passage through the engine compartment where is is subject to heat gain.

In order to limit heat gain in the fuel to the lowest possible level, it is desirable to place the recirculation valve assembly 28 in close proximity to the fuel tank 14. Such placement will avoid heat gain from underbody sources, in automotive applications, which would not be avoided if the valve assembly 28 were located in close proximity to the engine.

As indicated above, operation of the valve controlling solenoid 46 is through a controller such as ECM 50, which gathers information on various engine parameters from sensors located on or about the engine, and issues instructions based on desired engine operating conditions. Two control parameters useful to determine which fuel system mode is desirable are coolant temperature and operating time. When the engine is started, the controller 50 may command fuel recirculation for a given period of time based on coolant temperature. Such recirculation will assure that any fuel vapor in the fuel distributor 19 is removed. Additionally, periods of extended engine idle at extreme temperatures may lead to fuel vaporization which could affect engine operation. A period of fuel recirculation may be desirable in such cases to maintain acceptable engine performance. An alternative to the use of coolant temperature as an indicator for fuel recirculation may be the addition of a fuel temperature sensor. Recirculation decisions based on fuel temperature offers greater optimization of system performance since recirculation is dependent upon fuel condition.

The present invention has been described above with relation to its application on an engine utilizing one or more fuel rails having fuel injectors extending therefrom at predetermined intervals. In such a configuration, the fuel rail acts as a fuel manifold, or distributor of fuel to the injectors. It is, however, contemplated that this invention is applicable to other types of fuel injection systems. For example, it is known to replace the fuel rail with a centralized, fuel metering distributor from which a plurality of injector lines extend and at whose terminal ends are disposed individual injectors. The injectors are disposed, and operate within the intake manifold of the engine in much the same way as above described. Excess fuel supply to the distributor is often returned via a pressure relief valve to the fuel supply with consequential warming thereof. In such instances, the present invention may be employed to dead-head the fuel supply at the fuel metering distributor, spilling uncirculated fuel back to the fuel supply when operating conditions do not require recirculation.

In addition, the fuel system of the present invention has been described above having a valve assembly 28 which comprises a three-way, solenoid operated valve assembly. It is contemplated that the described valve assembly is but one valve configuration which may adequately serve the above described purpose. Other valve configurations may be applied to this system.

The present invention discloses a fuel system for an internal combustion engine having a simple means for providing fuel recirculation through a fuel distributor assembly only during engine operating conditions which dictate such action. During normal operation in which fuel recirculation is not required, the system blocks recirculation of fuel through the fuel distributor assembly thereby preventing heating of excess fuel returned to the fuel tank and consequent fuel tank warming. Such an invention aids in the reduction of fuel tank vapor and the possibility of emission of the additional vapor to the atmosphere.

The fuel system of the present invention provides a solution to the problem of running loss emissions caused by heated fuel return to the fuel tank. It will be appreciated by those skilled in the art that the present invention solves the aforementioned problem in a manner that minimizes interference with engine performance.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which an exclusive property or privilege is claimed are defined as follows:

1. A system for circulating fuel between a supply and a fuel distributor of an internal combustion engine, said fuel distributor having an inlet and an outlet, to which a fuel injector is operably connected and upon which a fuel pressure regulator acts to maintain a predetermined fuel pressure therein, said system comprising a valve assembly disposed within a valve chamber to which fuel from said supply is conducted, said valve operable in a first position to supply fuel through a supply conduit to the inlet of the fuel distributor for circulation therethrough, said valve assembly further comprising a return conduit operable in conjunction with the fuel distributor outlet to receive fuel from the distributor for return to the supply, and wherein said valve is operable in a second position in which said supply conduit is closed by said valve and fuel is supplied to said return conduit for transfer to the outlet of the fuel distributor for circulation to said injector, said valve operable in said second position to prevent circulation of said fuel through the distributor and to said supply.

2. A system for circulating fuel between a supply and an internal combustion engine having a fuel distributor, with an inlet and an outlet, to which a fuel injector is operably connected and upon which a fuel pressure regulator acts to maintain a predetermined fuel pressure within, said system comprising a valve assembly having a solenoid operated valve disposed within a valve chamber to which fuel from said supply is conducted, said solenoid operable to place said valve in a first position in which fuel is supplied through a supply conduit to the inlet of the distributor for circulation therethrough, said valve assembly further comprising a return conduit operable in conjunction with the distributor outlet to receive fuel from the distributor for return to the supply, and wherein said solenoid is operable to place said valve in a second position in which said supply conduit is closed and fuel is supplied to said return conduit for transfer to the outlet of the fuel distributor for circulation to said injector, said valve operable in said second position to prevent circulation of said fuel through the distributor and to said supply and wherein said pressure regulator is operable on said return conduit to maintain pressure in said fuel distributor by spilling fuel downstream therefrom when said valve is in said first position and by spilling fuel upstream therefrom when said valve is in said second position.

* * * * *